US005369883A

United States Patent [19]

So et al.

[11] Patent Number: 5,369,883

[45] Date of Patent: Dec. 6, 1994

[54] METHOD FOR MAKING AN IN TANK OIL COOLER

[75] Inventors: Allan K. So, Mississauga; Nicholas F. Avery, Oakville; David G. Rowntree, Brampton, all of Canada

[73] Assignee: Long Manufacturing Ltd., Oakville, Canada

[21] Appl. No.: 148,187

[22] Filed: Nov. 8, 1993

Related U.S. Application Data

[63] Continuation of Ser. No. 960,938, Oct. 14, 1992, abandoned, which is a continuation of Ser. No. 792,435, Nov. 15, 1991, abandoned, which is a continuation-in-part of Ser. No. 525,162, May 16, 1990, abandoned, which is a continuation-in-part of Ser. No. 363,496, Jun. 8, 1989, abandoned.

[30] Foreign Application Priority Data

Feb. 24, 1989 [CA] Canada ..... 592041

[51] Int. Cl.[5] ..... B23P 15/26

[52] U.S. Cl. ..... 29/890.039; 29/890.054

[58] Field of Search ..... 29/890.039, 890.054, 29/890.043; 165/41

[56] References Cited

U.S. PATENT DOCUMENTS

| | | | |
|---|---|---|---|
| 2,912,749 | 11/1959 | Bauernfeind | 29/157.3 |
| 3,116,541 | 1/1964 | Nickol et al. | 165/170 |
| 3,207,216 | 9/1965 | Donaldson | 165/148 |
| 3,250,325 | 5/1966 | Rhodes et al. | 165/153 |
| 3,402,764 | 9/1968 | Fairbanks | 165/51 |
| 3,757,856 | 9/1973 | Kun | 165/166 |
| 3,805,889 | 4/1974 | Coolidge | 165/153 |
| 4,271,901 | 6/1981 | Buchmüller | 165/165 |
| 4,350,201 | 9/1982 | Steineman | 165/76 |
| 4,470,455 | 9/1984 | Sacca | 165/167 |
| 4,592,414 | 6/1986 | Beasley | 165/76 |
| 4,600,053 | 6/1986 | Patel et al. | 165/170 |
| 4,800,954 | 1/1989 | Noguchi et al. | 165/153 |
| 5,036,911 | 8/1991 | So et al. | 165/153 |

FOREIGN PATENT DOCUMENTS

| | | |
|---|---|---|
| 219241 | 1/1958 | Australia . |
| 0124217 | 11/1984 | European Pat. Off. . |
| 0236859 | 3/1986 | European Pat. Off. . |
| 283937 | 9/1988 | European Pat. Off. . |
| 760888 | 3/1934 | France . |
| 2280871 | 2/1976 | France . |
| 2494418 | 11/1980 | France . |
| 2549593 | 7/1983 | France . |
| 1501537 | 6/1969 | Germany . |
| 2061825 | 6/1972 | Germany . |
| 2322730 | 5/1974 | Germany . |
| 3215961 | 11/1983 | Germany . |
| 3500571 | 11/1985 | Germany . |
| 3544921 | 12/1987 | Germany . |
| 62-13994 | 1/1987 | Japan . |
| 62-26494 | 2/1987 | Japan . |
| 490556 | 8/1938 | United Kingdom . |
| 1051601 | 1/1964 | United Kingdom . |
| 2026676 | 4/1979 | United Kingdom . |
| 380936 | 5/1973 | U.S.S.R. . |
| 553439 | 4/1977 | U.S.S.R. . |
| 1613837 | 12/1987 | U.S.S.R. . |

*Primary Examiner*—Irene Cuda

*Attorney, Agent, or Firm*—Baker & Daniels

[57] ABSTRACT

A heat exchanger and method of making same is disclosed. The heat exchanger is particularly useful for cooling automotive engine oil or transmission fluid, the exchanger being located inside the radiator or other part of the engine cooling system. The heat exchanger is made from a plurality of stacked plates formed of cladded metal, the plates being assembled into face-to-face pairs, each pair having a turbulizer located therein. The plates also have outwardly disposed dimples which are in contact when the plates are arranged back-to-back. The turbulizer is thicker than the spacing between the assembled plates prior to brazing the assembly. The dimples maintain good contact between all heat transfer surfaces while the assembly is completed by brazing.

11 Claims, 4 Drawing Sheets

METHOD FOR MAKING AN IN TANK OIL COOLER

BACKGROUND OF THE INVENTION

This is a continuation division of application Ser. No. 07/792,435, filed Nov. 15, 1991, abandoned, which is a continuation-in-part of application No. 07/525,162 filed May 16, 1990, now abandoned, which in turn is a continuation-in-part of application No. 07/363,496 filed Jun. 8, 1989, now abandoned.

FIELD OF THE INVENTION

This invention relates to a method for making heat exchangers, and in particular, to automotive oil coolers which are located inside other heat exchangers, such as automotive radiators.

In motor vehicles, it is common to provide heat exchangers for cooling engine oil or transmission fluid. Due to the heat transfer characteristics of oil, liquid cooled heat exchangers are normally used as opposed to air cooled exchangers. The most convenient way to do this is to mount the oil cooler or heat exchanger inside the cooling system of the motor vehicle, and in particular, inside the radiator.

In the past, the oil coolers of the type in question which have been mounted inside automotive radiators have consisted of concentric tubes closed at both ends to form an internal passage for the oil. The engine coolant flows around the outside tube and through the inside tube. A difficulty with this type of oil cooler, however, is that it is relatively ineffective per volume of radiator occupied.

SUMMARY OF THE INVENTION

The present invention is a plate type heat exchanger which is more effective per volume of radiator occupied, and yet is strong enough to withstand the high oil pressures that are frequently encountered in such engine oil or transmission fluid cooling systems.

According to the invention, there is provided a heat exchanger comprising a plurality of stacked plates arranged in face-to-face pairs, each of the face-to-face pairs including first and second plates. The first plate has a planar central portion, a raised peripheral co-planar edge portion extending above the central portion, and opposed co-planar end bosses extending below the central portion. The second plate of each face-to-face plate pair has a peripheral edge portion joined to the first plate peripheral edge portion, a central portion spaced from the first plate central portion, and opposed coplanar end bosses extending above the second plate central portion. The first and second plate central portions have opposed cladding layers formed thereon. A planar turbulizer is located between the first and second plate central portions of each face-to-face plate pair, the thickness of the turbulizing is being greater than the distance between the opposed cladding layers of the first and second plate central portions. The first and second plate central portions have a plurality of spaced-apart outwardly disposed dimples formed therein, the dimples extending equidistant with the end bosses. The first plate of one plate pair is located back-to-back with the second plate of an adjacent plate pair, the respective dimples and end bosses being joined together. Also, each plate pair defines inlet and outlet openings for the flow of fluid through the plate pair past the turbulizer.

According to yet another aspect of the invention, there is provided a method of making a heat exchanger comprising the steps of providing a plurality of plates each having a planar central portion, a raised peripheral edge portion, a brazing cladding layer formed on the plates and inlet and outlet openings formed therein. The plates are arranged face-to-face into pairs having a hollow space therebetween. A turbulizer is inserted into the hollow space, the turbulizer being in contact with the planar central portions of each plate of a plate pair and of a thickness generally equal to the distance between the planar central portions without the cladding layers formed thereon. A plurality of said face-to-face plate pairs is stacked so that the inlet and outlet openings are in registration and the raised peripheral edges are separated. Also, the stacked plate pairs are heated to melt the cladding layers causing the turbulizer to be embedded in the cladding layers and the peripheral edges to be joined to form a fluid tight assembly.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENT

Figure 1:
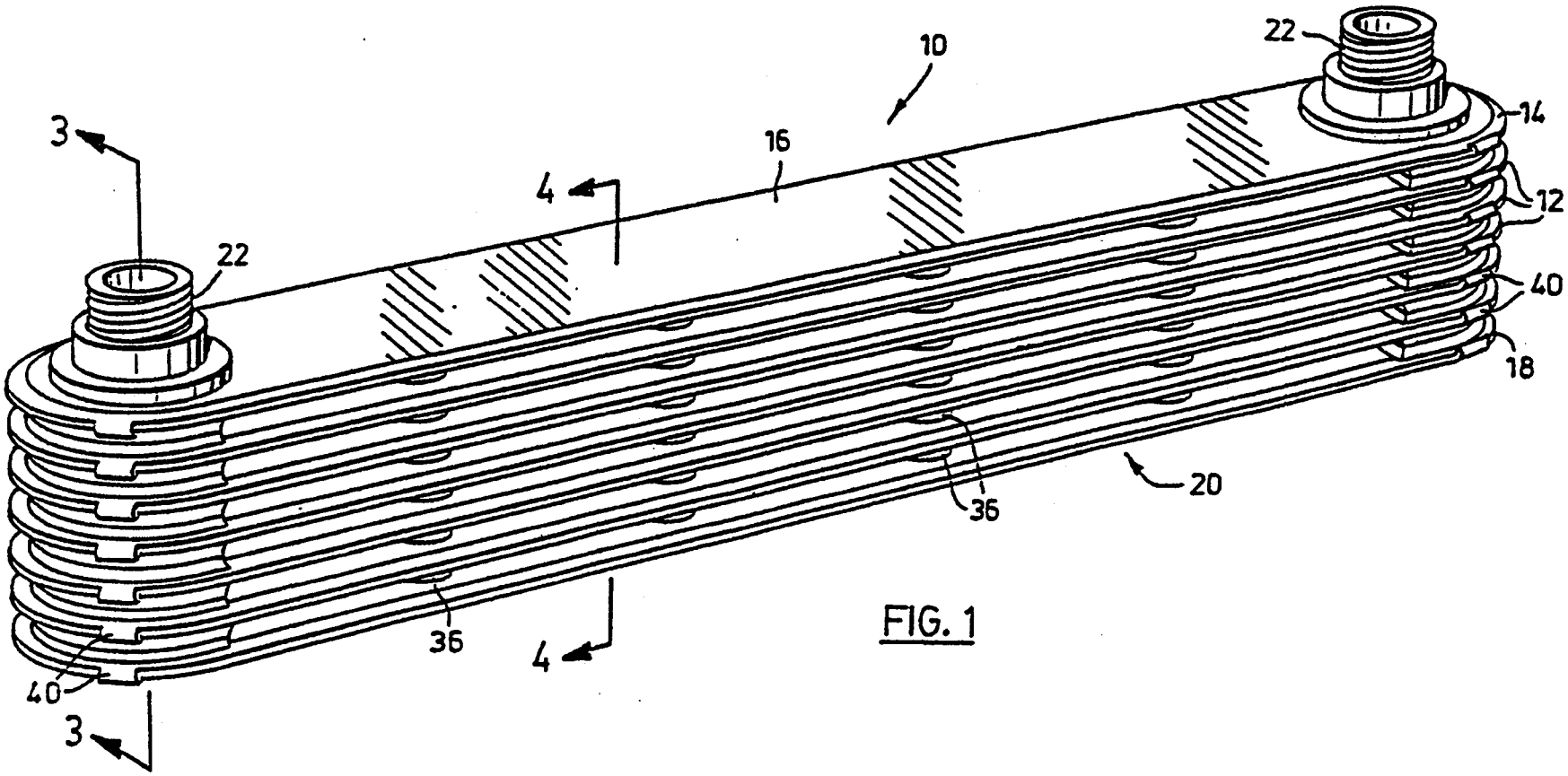
FIG. 1 is a perspective view of a preferred embodiment of an in tank oil cooler according to the present invention.
Figure 2:
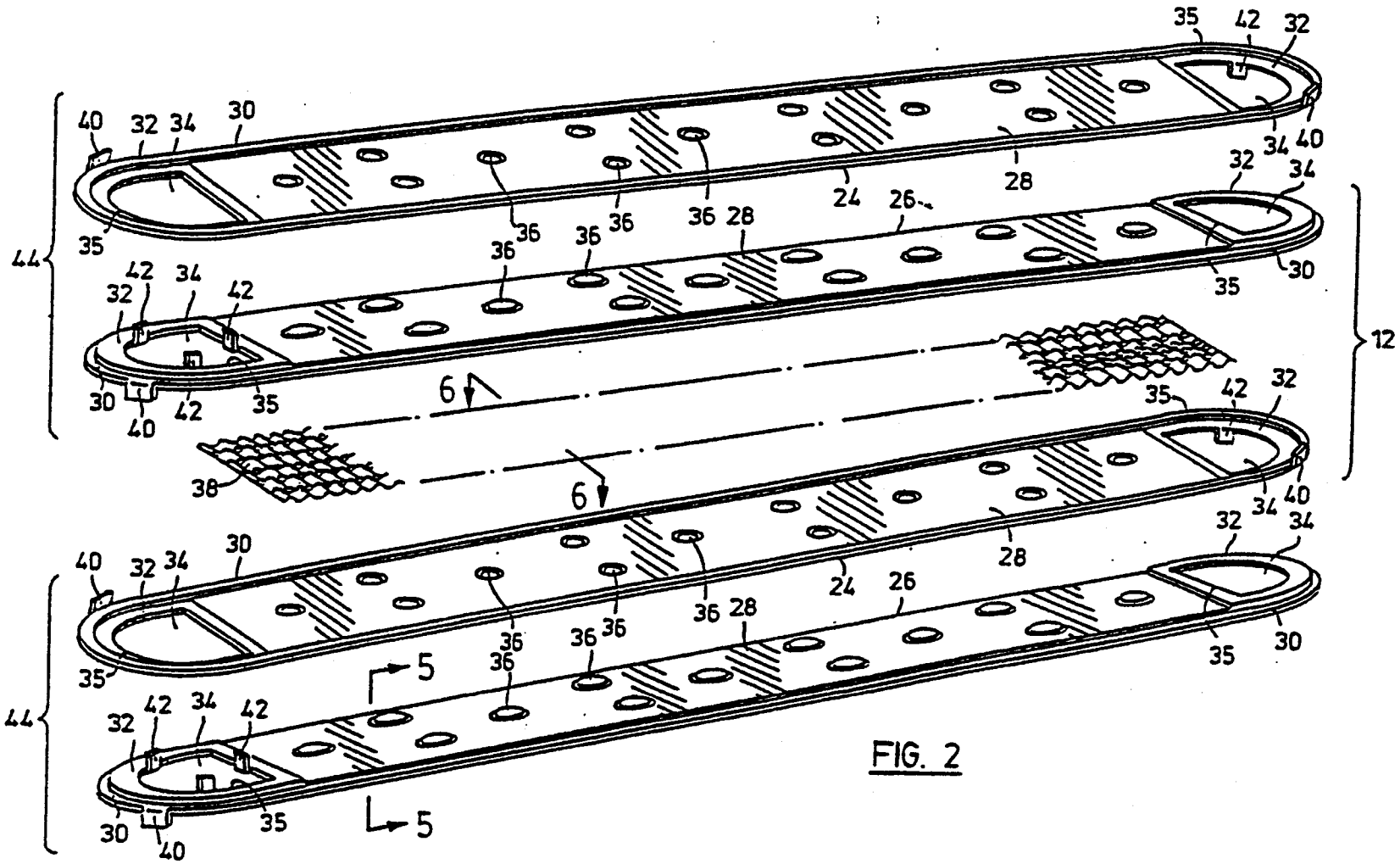
FIG. 2 is an exploded perspective view of a subassembly of the oil cooler of FIG. 1.

Referring to the drawings, a preferred embodiment of an oil cooler or heat exchanger is generally represented by reference numeral 10 in FIG. 1. Heat exchanger 10 is formed of a plurality of face-to-face plate pairs 12 as described in detail below with reference to FIG. 2. A top plate pair 14 has a smooth top plate 16 and a bottom plate pair 18 has a smooth bottom plate 20, although top and bottom plates 16, 20 could be dimpled as shown in FIG. 2 if desired. Heat exchanger 10 also has threaded nipples 22 swaged in place in suitable circular openings in top plate 16. One nipple 22 serves as an inlet and the other nipple 22 serves as an outlet for the flow of oil, such as engine oil or transmission fluid through heat exchanger 10.

Referring in particular to FIG. 2, a typical face-to-face plate pair 12 is shown in an exploded perspective view. Plate pair 12 includes a first or bottom plate 24 and a second or top plate 26. First plate 24 has a planar central portion 28, and a raised peripheral, co-planar edge portion 30 which extends above or is located in a plane above central portion 28. First plate 24 also includes opposed, co-planar end bosses 32 extending below or located at a lower level than central portion 28. For the purposes of this disclosure, the term "co-planar" is intended to mean being in a plane parallel to the plane of central portion 28.

In the preferred embodiment, the first and second plates 24, 26 are identical, so the terms "below" and "above" with reference to the central portion 28 of first plate 24 would, of course, be reversed with reference to the central portion 28 of second plate 26 as seen in FIG. 2.

The ends of plates 16, 20, 24 and 26 are rounded and end bosses 32 of plates 24, 26 are formed with "D"-shaped openings 34, although any shaped opening could be used if desired. The "D"-shaped openings 34 have an opening edge portion 35 located around "D"-shaped openings 34. As mentioned above, smooth top plate 16 has circular openings to accommodate nipples 22. The smooth bottom plate 20 has no openings formed therein.

First and second plates 24, 26 are formed with a plurality of spaced-apart dimples 36 formed therein. With reference to first plate 24, dimples 36 extend below the central portion 28 equidistant or to the same planar level as end bosses 32, so that when two of the plates 24, 26 are located back-to-back as seen best in FIG. 3, the respective dimples 36 and end bosses 32 are joined together along a common plane.

A turbulizer 38 is located inside each face-to-face plate pair 12, including top and bottom plate pairs 14, 18. Turbulizer 38 is a strip of expanded metal. The preferred configuration is parallel rows shaped in a sinusoidal, staggered configuration, although other configurations could be used as desired. The length of turbulizer 38 corresponds with the length of the plate central portions 28, and the width of turbulizer 38 corresponds with the distance between peripheral edge portions 30. The thickness of turbulizer 38 is such that after the plate pairs are assembled and heat exchanger 10 is joined together, such as by brazing, the plate central portions 28 are joined to and in good thermal contact with turbulizer 38, as discussed further below.

Dimples 36 are spaced uniformly over the plate central portions 28. One of the primary functions of dimples 36 is to support the plate central portions 28 and prevent these central portions from sagging when the plates are heated to brazing temperatures. Central portions 28 must be kept flat and in full contact with turbulizer 38 during the brazing process in order to obtain good thermal contact between the turbulizer and the plates. Another function of the dimples is to cause some turbulence in the coolant thereby increasing the heat transfer capabilities of the heat exchanger. When the plates are in back-to-back arrangement dimples 36 maintain the back-to-back plates in spaced apart relation so that the coolant would have an effective path between the back-to-back plates. The height of dimples 36 should be optimized in that the dimples should be tall enough to allow the coolant to flow between the back-to-back plates but not too tall because of the overall size of heat exchanger 10 should be minimized where possible.

Dimples 36 preferably are large enough to result in flat top surfaces to give a good joint between mating dimples 36. As seen best in FIGS. 3 and 4, the radius of the shoulders in the dimples should be such that sharp corners should be avoided or the dimples could break out as a result of high pressures in heat exchanger 10.

Dimples 36 should also not be too large in diameter, because the surface area of central portion 28 occupied by dimples 36 is area that is not in contact with turbulizer 38 and this detracts from the heat transfer efficiency of heat exchanger 10. It will be apparent to those skilled in the art that the number and size of the dimples 36 should be chosen so that sufficient strength and structural support for the plate central portions is provided during the brazing process, and so that the gain in heat transfer efficiency through turbulence in the coolant is balanced against loss of heat transfer efficiency by making the dimples too numerous or too large. It has been found that for plates with central portions 28 of approximately four centimetres in width, dimples that are 0.5 centimetres in diameter and spaced-apart longitudinally about 2.5 to 3.0 centimetres and transversely about 2 to 3 centimetres provides a preferred balance where aluminum of 0.07 to 0.08 centimetres thickness is used for the plates.

Referring to FIG. 2, plates 24, 26 may be formed with inner tabs 42 extending transversely from opening edge portion 35. Inner tabs 42 are located at only one end of each plate so that upon assembly, inner tabs 42 on one plate such as first plate 24 are crimped over the opening edge portion 35 of the mating plate 26, when the plates are in a back-to-back arrangement to form a back-to-back plate pair 44. This prevents the plates of each back-to-back plate pair 44 from moving longitudinally or transversely relative to each other. Inner tabs 42 are not necessary, however, and may be eliminated if alignment of the plate pairs is not a problem.

Referring again to FIG. 2, plates 24, 26 are formed with peripheral tabs 40 at opposed ends. Peripheral tabs 40 are located at respective diametrically opposed "corners" of each plate, so that upon assembly, the peripheral tabs 40 on one plate, such as first plate 24, are crimped over the peripheral edge portion 30 of the mating plate, such as second plate 26, when the plates are in face-to-face arrangement to form face-to-face plate pair 12 as seen best in FIG. 1. This prevents the plates of each face-to-face plate pair 12 from moving longitudinally or transversely relative to each other. Again, peripheral tabs 40 are not necessary and may be eliminated if alignment of the plates is not a problem.

Figure 3:
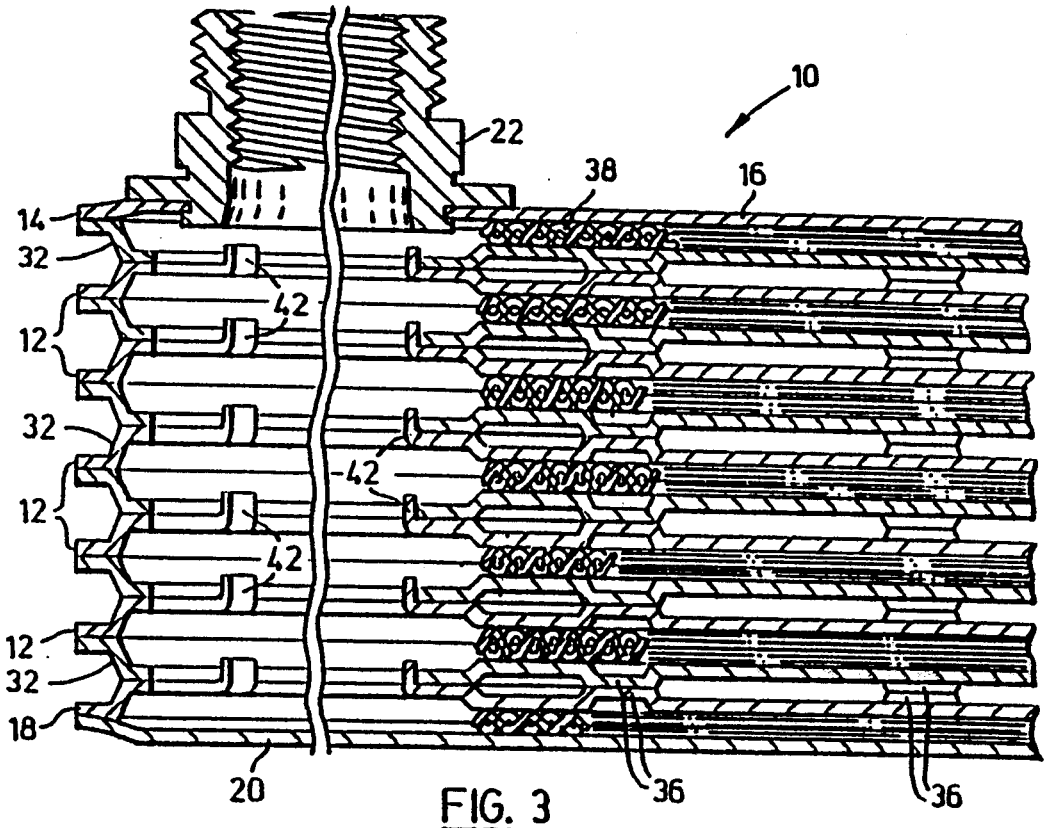
FIG. 3 is a partial sectional view taken along lines 3—3 of FIG. 1 and showing an alternate embodiment.

In an alternate embodiment shown in the left hand portion of FIG. 3, the inner tabs 42 can be used to maintain the first and second plates, of the back-to-back plate pairs in alignment, without crimping over the inner tabs 42. Similarly the peripheral tabs 40 can be used to maintain the first and second plates of the face-to-face plate pair in alignment without crimping over the peripheral tabs 40. It will be apparent to those skilled in the art that the peripheral tabs 40 and the inner tabs 42 may be used to align the stacked plates or to mechanically attach the plates as desired. The heat exchanger can be further modified by eliminating the peripheral tabs 40 and inner tabs 42 and stacking plates in the pattern described above and shown in FIG. 3.

Figure 5:
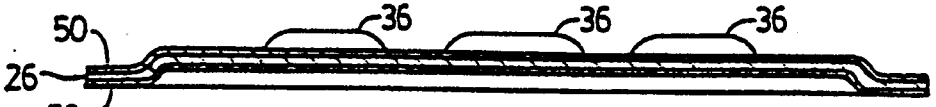
FIG. 5 is an enlarged sectional view taken along lines 5—5 of FIG. 2.

In the preferred embodiment, aluminum is used for all of the components of heat exchanger 10. Nipples 22 and turbulizer 38 are formed of aluminum alloys, and plates 16, 20, 24 and 26 are formed of brazing clad aluminum, which is aluminum that has a lower melting point cladding or aluminum brazing alloy layer 50 on the outer surfaces, as seen best in FIGS. 5, 7 and 8 the cladding layers 50 are each about 8 to 10 per cent of the thickness of the plate.

Figure 8:
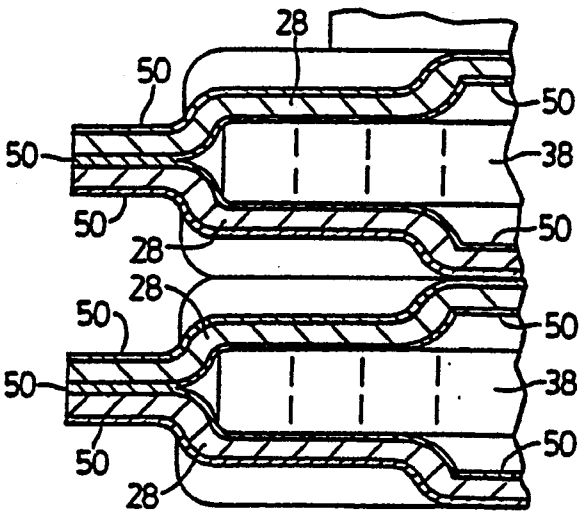
FIG. 8 is partial sectional view similar to FIG. 7 but showing the stacked plate pairs after brazing.
Figure 7:
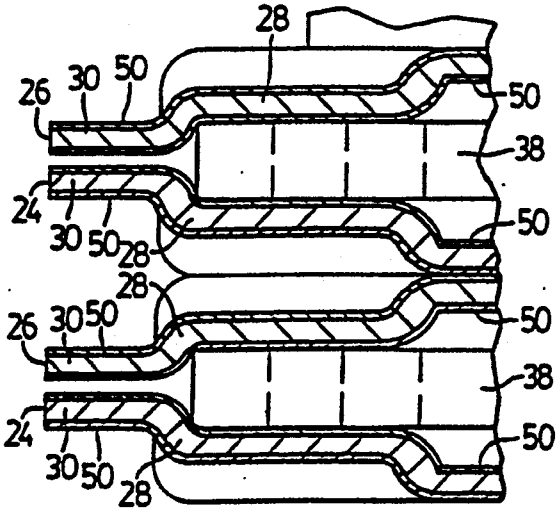
FIG. 7 is a partial sectional view taken along lines 7—7 of FIG. 6 but showing a plurality of stacked plate pairs prior to brazing.

As seen best in FIGS. 7 and 8 the thickness of turbulizer 38 is generally equal to the distance between the first and second plate central portions 28 without cladding layers 50. In other words, the thickness of turbulizer 38 is greater than the distance between the opposed cladding layers 50 of the first and second plate central portions 28 after final assembly. The reason for this is that as these cladding layers 50 melt during the brazing process, all of the high areas of turbulizer 38 are embedded in the cladding layers 50 and turbulizer 38 is brazed to the plate central portions 28 with good thermal heat transfer and minimum drag or pressure drop as the oil flows through or past turbulizer 38, as will be described further below.

The assembly of heat exchanger 10 starts by arranging the plates 24, 26 face-to-face or back-to-back as desired, as seen best in FIG. 2, so that the "D"-shaped openings 34 and the respective peripheral edge portions 30 are in registration. If inner tabs 42 are used, these tabs may be first crimped over to form back-to-back plate pairs 44. A turbulizer 38 is then inserted into the hollow space between the central portions 28 of each face-to-face plate pair 12. If peripheral tabs 40 are used, these may then be crimped over the peripheral edge portions 30 of the respective mating plate. Alternatively several of the assembled plate pairs 12 may be formed with turbulizers in them and then stacked together, in which case tabs 42 would not be crimped over or used at all. The particular method or sequence of stacking plates 24, 26 together does not matter, the result is a plurality of stacked plate pairs as illustrated in FIGS. 2 and 7.

Figure 4:
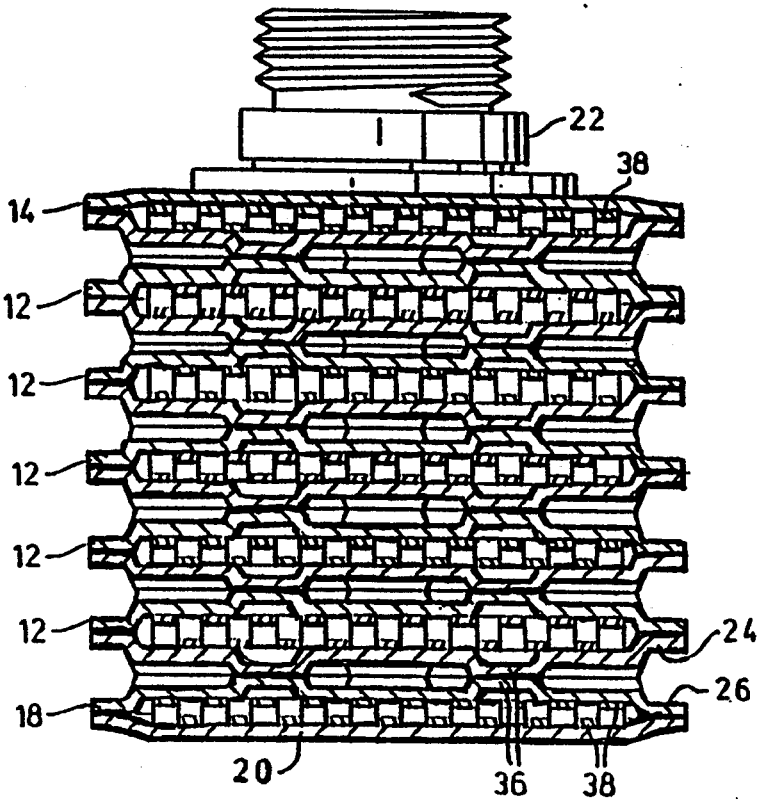
FIG. 4 is a sectional view taken along lines 4—4 of FIG. 1.

The top plate pair 14 is then formed by swaging nipples 22 onto smooth top plate 16 and stacking this on top of one of the plates as shown in FIGS. 1 and 3. Bottom plate pair 18 is then formed using a smooth bottom plate 20 located below the bottom plate 26 as shown in FIGS. 3 and 4.

Figure 6:
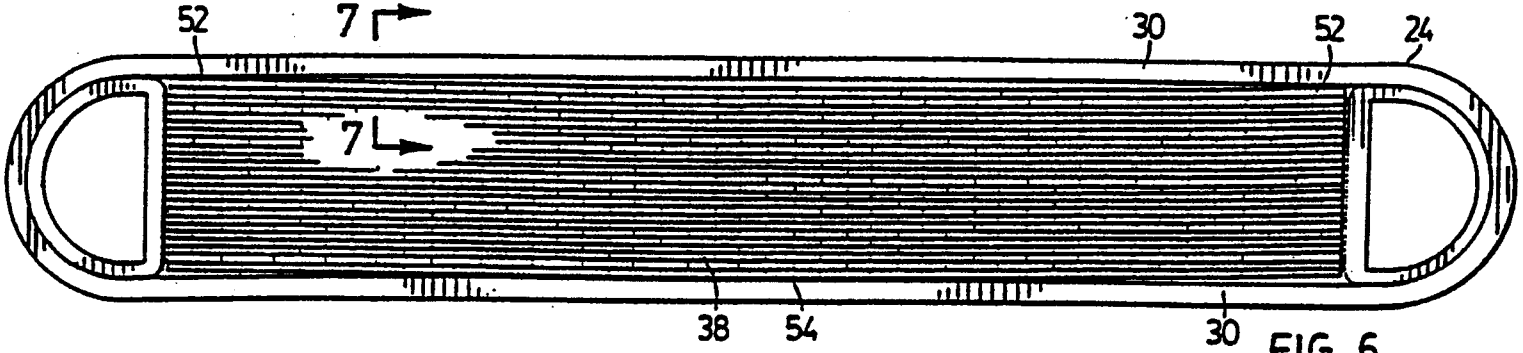
FIG. 6 is an enlarged plan view taken along lines 6—6 of FIG. 2.

As seen best in FIG. 6, turbulizer 38 typically is not longitudinally straight, but has a slight transverse camber in it because the metal from which it is formed usually comes in rolled form. This causes the corners 52 and the central portions 54 to overlap or ride into the radius between central portion 28 and peripheral edge 30. However, cladding layers 50 and these radii themselves accommodate this overlap in the brazing process as described next below.

Once the entire heat exchanger is assembled, it is then placed into a brazing furnace using a suitable fixture to maintain the orientation of the assembly, to braze together simultaneously all mating surfaces prior to entering the brazing furnace, the stacked plates appear as shown in FIG. 7, with about a 0.3 m.m. gap between the peripheral edge portions 30 due to the thickness of turbulizer 38 as discussed above. The stacked plates are squeezed together and as the cladding layers 50 melt, peripheral edges 30 come together accommodating any misalignment and dimensional intolerances giving upon cooling a fluid tight assembly.

Having described preferred embodiments of the invention, it will be appreciated that various modifications may be made to the structures described. In certain instances it may be desirable to vary the location of the nipples 22 serving as inlets and outlets for the oil. For example, one nipple 22 could be positioned in the top plate 16 and the other nipple 22 in the bottom plate 20. In the case where the nipples 22 are located at the same end of respective top and bottom plates 16, 20 a central plate with no opening at that end could be positioned in the middle portion of heat exchanger 10.

Heat exchanger 10 can be made from other materials than aluminum, such as stainless steel or brass. In the case of stainless steel, either a brazing cladding layer of copper or thin copper sheets or shims could be used. For the purposes of this disclosure the term "cladding layer" is intended to include any type material to join respective components, such as a coating or metal deposit, a discreet or separate layer of brazing material, solder or even a suitable adhesive. Obviously, any number of plate pairs could be used. Soft soldering may also be used instead of brazing, however in general, this produces a weaker connection and therefore may not meet the strength requirements. The length of the plates can be varied simply by repeating longitudinally the dimple diameter and spacing described above. If both the length and the width of the heat exchanger is to be varied, the diameter and spacing of the dimples may have to be varied slightly in keeping with the parameters discussed above.

From the above, it will be appreciated that the oil cooler of the present invention is a relatively high efficiency heat exchanger which is structurally strong with relatively low pressure drop.

What we claim as our invention is:

1. A method of making a heat exchanger comprising:
providing a plurality of plates, each plate having a planar central portion, a raised, peripheral edge portion located above and in a plane parallel to the central portion, and opposed end bosses located below and in a plane parallel to the central portion, the end bosses having inlet and outlet openings formed therein;
arranging said plates into a face-to-face pair having mating peripheral edge portions and a hollow space therebetween;
inserting a turbulizer into said hollow space, the turbulizer being of such thickness that the mating peripheral edge portions are spaced apart;
heating the plate pair;
compressing the turbulizer by pressing the plate pair together thereby drawing the mating peripheral edge portions together; and
joining contacting areas of the plates and turbulizer to form a fluid tight assembly.

2. A method as claimed in claim 1 wherein the step of compressing is done by squeezing together the planar central portions.

3. A method as claimed in claim 1 and further comprising the steps of providing a cladding layer on the plates, melting the cladding layer while compressing the turbulizer and embedding the turbulizer in the cladding layer until the peripheral edge portions come into contact.

4. A method as claimed in claim 3 and further comprising the step of crimping a peripheral edge portion of the turbulizer by the plates of the plate pair at a location between the planar central portions and the plate peripheral edge portions.

5. A method as claimed in claim 2 wherein the squeezing step is done by providing said central portions with a plurality of spaced-apart, outwardly disposed dimples, the dimples extending equidistant with the end bosses; and squeezing one plate pair between two adjacent plate pairs positioned in a back-to-back arrangement, the dimples on the adjacent plate pairs being in alignment and transmitting compressive forces therebetween.

6. A method as claimed in claim 2 and further comprising the steps of assembling a plurality of said plate pairs into a stack with said inlet and outlet openings in registration, and joining said plate pairs together in a fluid tight assembly.

7. A method as claimed in claim 1 and further comprising the step prior to compressing and heating the plate pair of assembling a plurality of said plate pairs into a stack with the inlet and outlet openings in registration, and then simultaneously heating and compressing all of the stacked plate pairs.

8. A method as claimed in claim 3 wherein the plates are formed of brazing clad aluminum, and wherein the step of joining is done by furnace brazing.

9. A method as claimed in claim 7 wherein the plates are formed of brazing clad aluminum, and wherein the step of joining is done by furnace brazing.

10. A method as claimed in claim 7 and further comprising the step, prior to heating and compressing all of the stacked plate pairs, of adding a top plate pair having a smooth top plate and a bottom plate pair having a smooth bottom plate to the stack of plate pairs.

11. A method as claimed in claim 10 and further comprising the step of providing inlet and outlet nipples on one of the smooth top and bottom plate, said nipples having inlet and outlet openings communicating with respective inlet and outlet openings of the plate pairs.

* * * * *

UNITED STATES PATENT AND TRADEMARK OFFICE

CERTIFICATE OF CORRECTION

PATENT NO. : 5,369,883

DATED : December 6, 1994

INVENTOR(S) : Alan K. So, et al

It is certified that error appears in the above-indentified patent and that said Letters Patent is hereby corrected as shown below:

Claim 1, column 6, line 37, after "heating" insert --and partially melting--; after "pair" insert --while said mating peripheral edge portions are still spaced apart--.

Claim 1, column 6, line 39, after "thereby" insert --melting the turbulizer into said central portions--.

Claim 1, column 6, line 41, after "turbulizer" insert --after the mating peripheral edge portions are drawn together--.

Claim 11, column 8, line 11, delete "plate" and substitute therefor --plates--.

Signed and Sealed this

Seventh Day of March, 1995

*Attest:*

*Attesting Officer*

Bruce Lehman

BRUCE LEHMAN

*Commissioner of Patents and Trademarks*